US006674034B1

(12) United States Patent
Wang

(10) Patent No.: US 6,674,034 B1
(45) Date of Patent: Jan. 6, 2004

(54) PRESS BUTTON TYPE SAFETY SWITCH

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/251,949

(22) Filed: Sep. 23, 2002

(51) Int. Cl.[7] ..... H01H 3/12
(52) U.S. Cl. ..... 200/341; 200/334; 337/66
(58) Field of Search ..... 200/339, 341, 200/453, 510, 283, 520, 529, 334; 337/66, 59, 72

(56) References Cited

U.S. PATENT DOCUMENTS 3,165,611 A * 1/1965 Hagberg ..... 200/529
5,508,485 A * 4/1996 Nishikawa ..... 200/525
5,521,347 A * 5/1996 Imaeda et al. ..... 200/525
6,069,545 A * 5/2000 Van Zeeland ..... 335/207
6,335,500 B1 * 1/2002 Chi et al. ..... 200/341
6,462,292 B1 * 10/2002 Wang ..... 200/315
6,469,610 B1 * 10/2002 Chen ..... 337/66
6,552,643 B2 * 4/2003 Chen ..... 337/66
6,552,644 B2 * 4/2003 Yu ..... 337/66

* cited by examiner

*Primary Examiner*—Elvin Enad
*Assistant Examiner*—Lisa N Klaus
(74) *Attorney, Agent, or Firm*—Rosenberg, Klein & Lee

(57) ABSTRACT

A press button type safety switch is constructed to include a switching mechanism, a seesaw plank controlled by a press button assembly to switch on/off the switching mechanism, two spring members supporting the press button assembly in the upper limit (off) position, two locating rods horizontally aligned at two sides of the press button assembly, and two hooks upwardly extended from the seesaw plank and adapted to hook the locating rods of the press button assembly and to hold the press button assembly in a lower position spaced below the upper limit (off) position when the switching mechanism switched on, the hooks being disengaged from the press button assembly for enabling the press button assembly to be moved upwards to the upper limit position when the switching mechanism switched off or the safety switch automatically tripped off upon an overcurrent.

3 Claims, 13 Drawing Sheets

PRESS BUTTON TYPE SAFETY SWITCH

BACKGROUND OF THE INVENTION

1. Field of the Invention

The present invention relates to electric switches and, more particularly, to a press button type safety switch, which automatically trips off upon an overcurrent and, which enables the user to view the on/off status of the safety switch from its outer appearance.

2. Description of the Related Art

A variety of electric switches, including seesaw switches and press button switches are known. In early days, a press button switch has only ON→OFF function, and cannot trip off automatically upon an overcurrent. In order to eliminate this problem, a variety of safety switches are developed. Regular safety switches are commonly of seesaw switching type.

FIGS. 1A and 1B show a seesaw switch 1 invented by the present inventor. This design of seesaw switch 1 uses a plank 11 to move a conducting plate 12 between on/off positions. When an overcurrent occurred, the conducting plate 12 automatically trips off the contact 121.

FIGS. 2A~2E show an overload protective press button switch according to the prior art. This structure of overload protective press button switch comprises a housing 31, the housing 31 having a top opening 311 and two open chambers 313 and 314 separated by a partition plate 312, a metal contact unit 33 installed in the housing 31, a switching mechanism 35, a press button assembly 32, and a linkage 34. The linkage 34 comprises a spring member 342 supported on the partition plate 312, a press member 341 mounted on the spring member 342, and a swivel holder 344 pivoted to the housing 31. The swivel holder 344 has a guide hole 343, which receives the press member 341, and a positioning portion 345 connected to the switching mechanism 35.

When pressed the press button assembly 32, the press member 341 is forced downwards to compress the spring member 342 and to bias the swivel holder 344, thereby causing the switching mechanism 35 to switch on the metal contact unit 33. When switched on, the spring member 342 pushes the press member 341 back to the initial position. The upper part I of this overload protective press button switch is similar to the design of the aforesaid prior art press button switch. The lower part II of this overload protective press button switch is similar to the design of the aforesaid prior art seesaw switch. This design is similar to Yu's Taiwan utility model no. 83365 (equivalent to U.S. Pat. No. 5,262,748) with the exception of the additional press button assembly 32. The swivel holder 344 is equivalent to Yu's seesaw plank. This structure of overload protective press button switch is complicated, resulting in high manufacturing cost and inconvenience of use. When the push button assembly 32 pressed to the position shown in FIG. 2C, and the swivel holder 344 is biased leftwards, the metal contact unit 33 is switched on. When the user released the hand from the push button assembly 32, the push button assembly 32 is moved to the position shown in FIG. 2D. Viewing from the outside, it shows no difference between the position of FIG. 2B and the opposition of FIG. 2D, therefore the user cannot know on or off status of the switch when viewed from the outside. For on/off indication, a complicated indicator circuit must be installed.

SUMMARY OF THE INVENTION

The present invention has been accomplished under the circumstances in view. It is one object of the present invention to provide a press button type overload protective safety switch, which enables the user to know "on or off status of the switch from the outer appearance of the switch. It is another object of the present invention to provide a press button type overload protective safety switch, which automatically trips off upon an overcurrent. It is still another object of the present invention to provide a press button type safety switch, which is simple and inexpensive to manufacture. To achieve these and other objects of the present invention, the press button type safety switch comprises a housing, the housing having a holding chamber separated by a horizontal partition wall thereof into an upper open chamber and a lower receiving chamber, and a through hole through the horizontal partition wall in communication between the upper open chamber and the lower receiving chamber; a plurality of terminals installed in the lower receiving chamber of the housing and electrically connected to external power supply; a switching mechanism installed in the lower receiving chamber of the housing and controlled to switch on/off the circuit of the terminals; a linkage adapted to switch on/off the switching mechanism, the linkage comprising spring members supported in the upper open chamber of the housing, a press button assembly supported on the spring members in the upper open chamber of the housing, and an actuating mechanism mounted in the through hole of the housing and connected between the press button assembly and the switching mechanism and controlled by the press button assembly to switch on/off the switching mechanism, the actuating mechanism comprising a conical spring mounted on the partition wall, a press member supported on the conical spring and partially inserted into the through hole of the housing, and a seesaw plank pivoted to the housing, the seesaw plank having a guide groove, which receives the press member for enabling the seesaw plank to be biased by the press member to switch on/off the switching mechanism, and a positioning portion disposed at one end thereof and connected to the switching mechanism; wherein: the linkage comprises at least one locating rod; the seesaw plank comprises at least one top hook adapted to hook on the at least one locating rod of the press button assembly to hold the press button assembly in a position where the spring members in the upper open chamber of the housing maintained compressed by the press button assembly when the press button assembly pressed by the user to switch on the switching mechanism.

BRIEF DESCRIPTION OF THE DRAWINGS

FIG. 2D is similar to FIG. 2C but showing the press button assembly returned to its upper limit position after the safety switch switched on.

FIG. 4B is similar to FIG. 4A but showing the press button type safety switch switched on.

FIG. 8A is a sectional view taken along line 8A—8A of FIG. 8.

DETAILED DESCRIPTION OF THE PREFERRED EMBODIMENT

Figure 1:
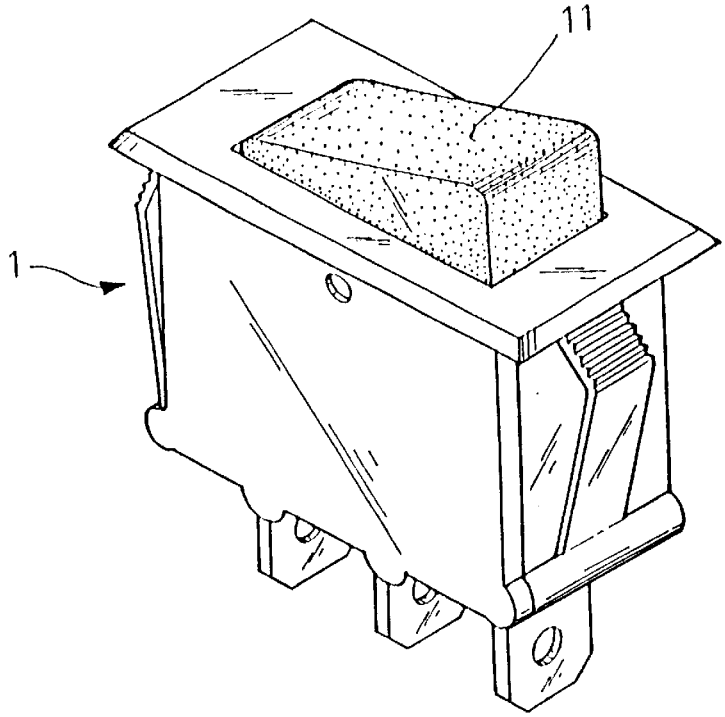
FIG. 1 (A) PRIOR ART
FIG. 1A is an elevational view of a seesaw switch according to the prior art.
FIG. 1B is a sectional view of the seesaw switch shown in FIG. 1A.
Figure 1:
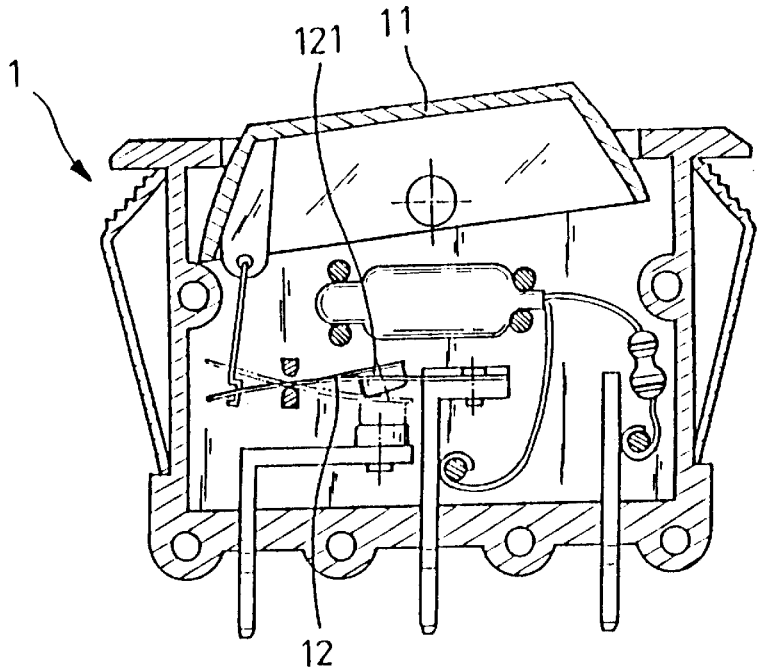
FIG. 1 (B) PRIOR ART
Figure 2A:
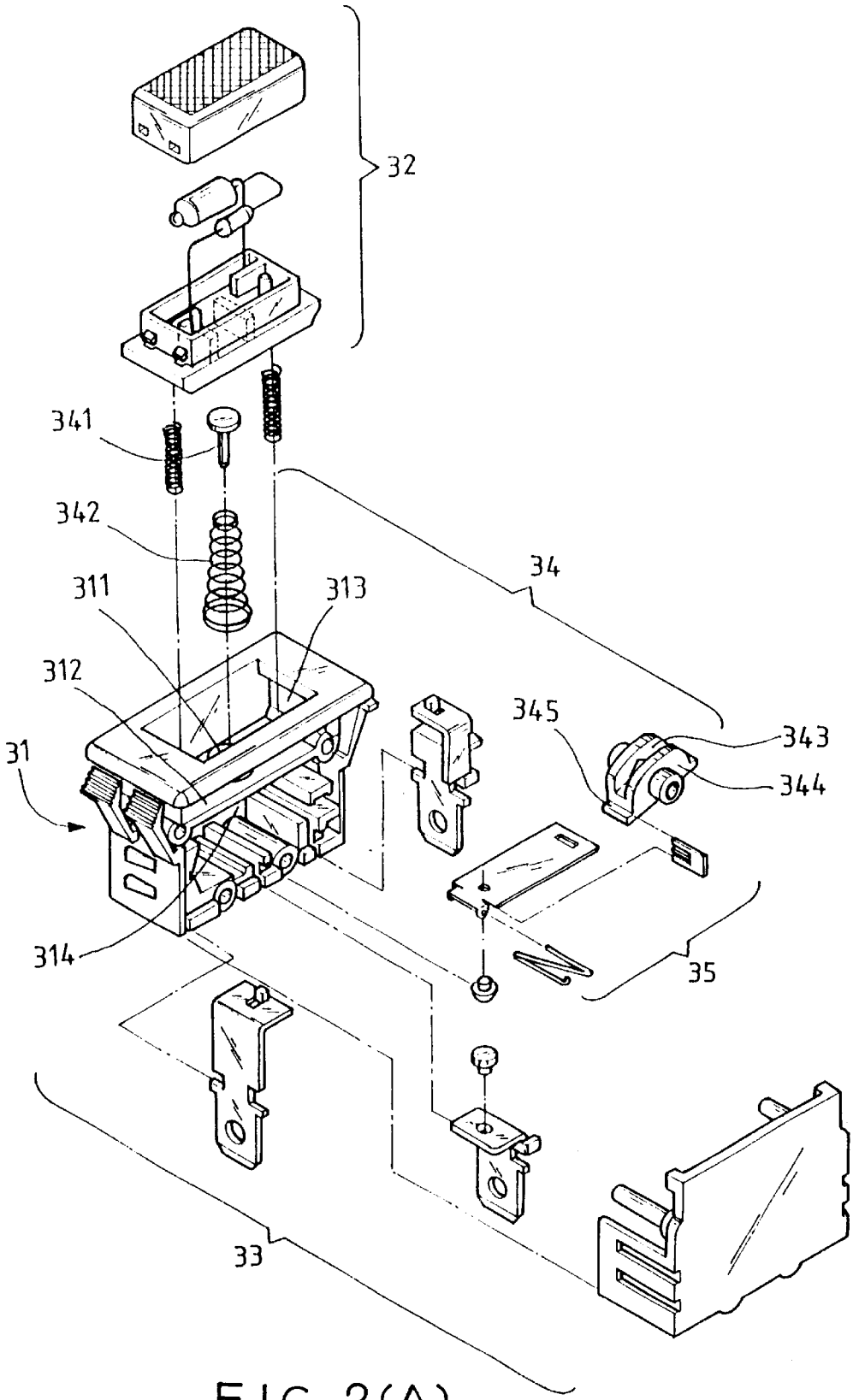
FIG. 2(A) PRIOR ART
FIG. 2A is an exploded view of a press button type safety switch according to the prior art.
Figure 2B:
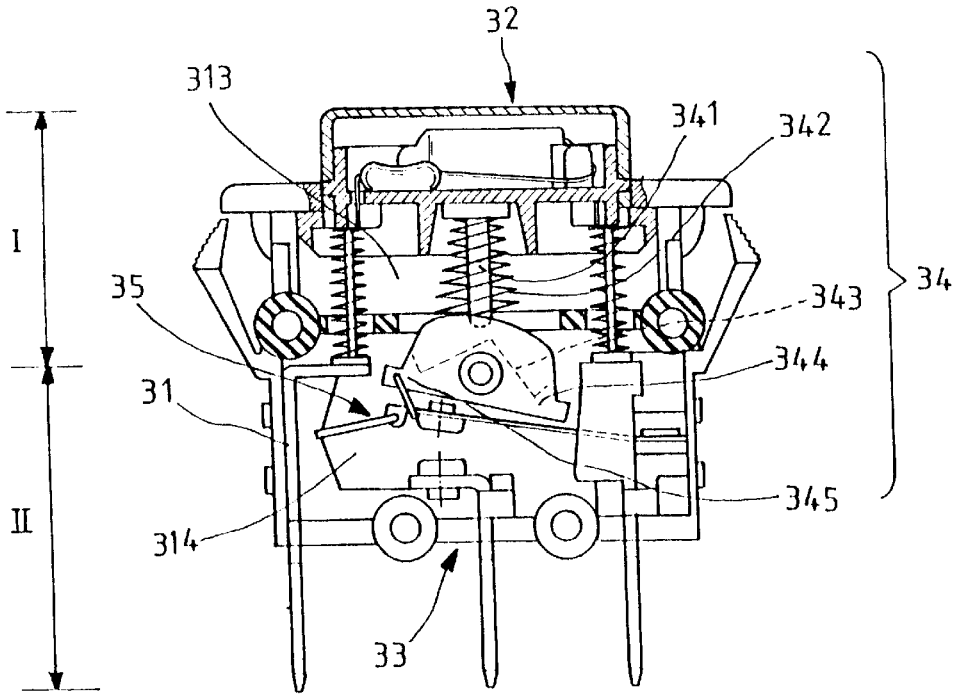
FIG. 2(B) PRIOR ART
FIG. 2B is a sectional view of the press button type safety switch shown in FIG. 2A.
Figure 2C:
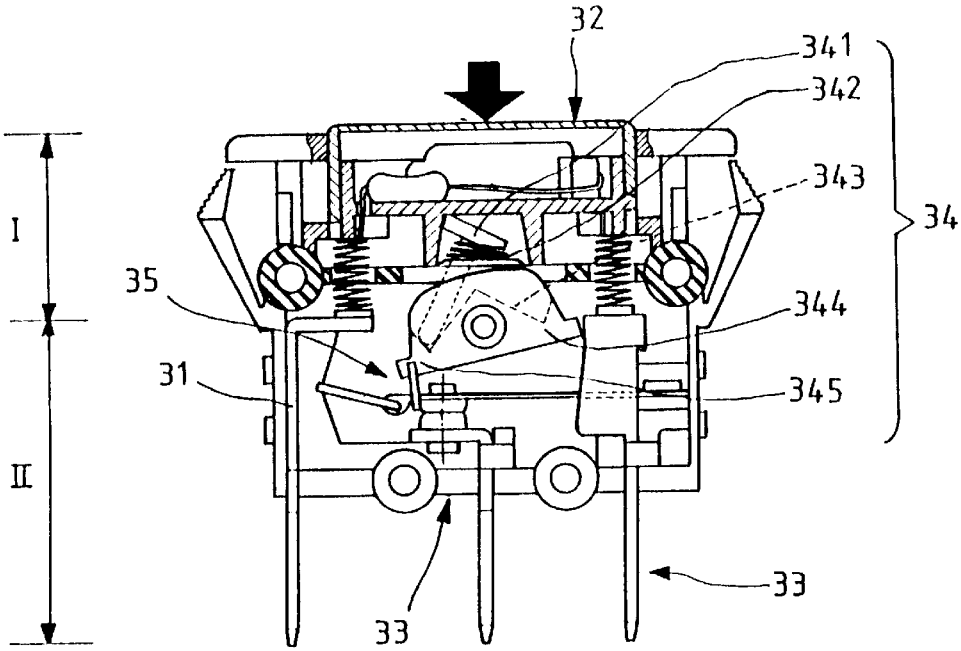
FIG. 2(C) PRIOR ART
FIG. 2C is similar to FIG. 2B but shown the press button assembly initially pressed.
Figure 2D:
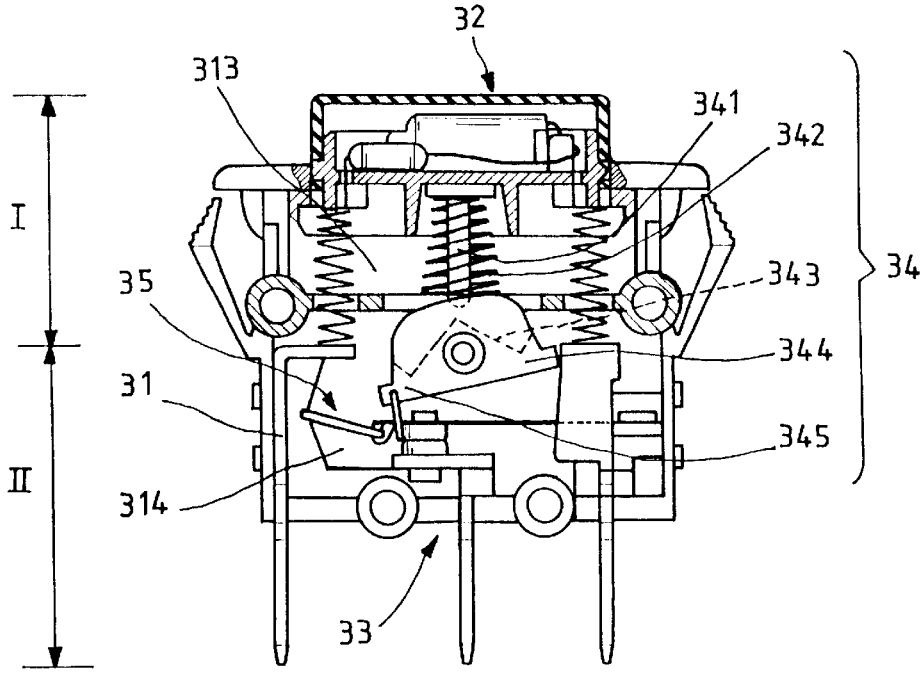
FIG. 2(D) PRIOR ART
Figure 2E:
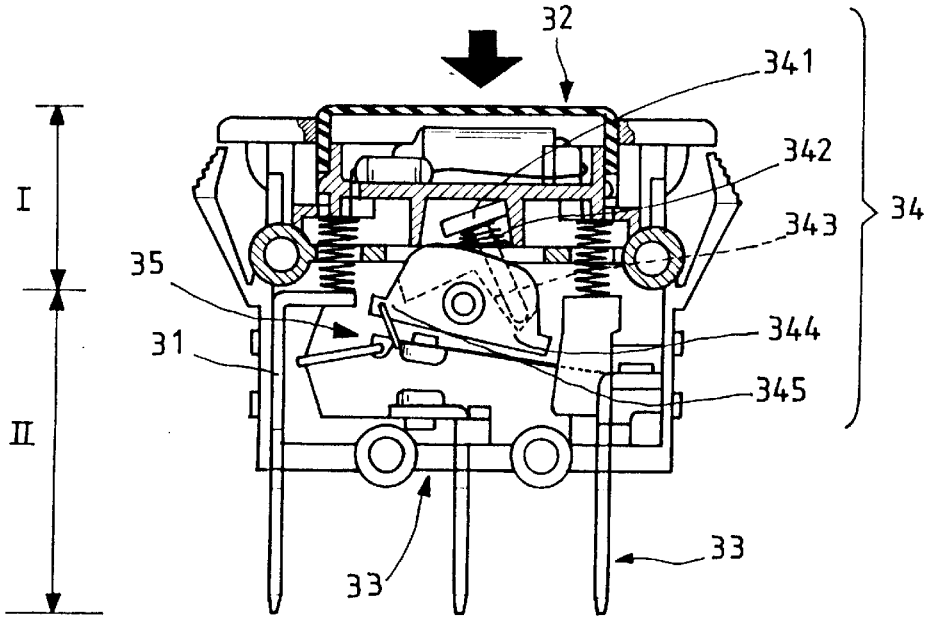
FIG. 2(E) PRIOR ART
FIG. 2E is similar to FIG. 2D but showing the press button assembly pressed again.
Figure 3:
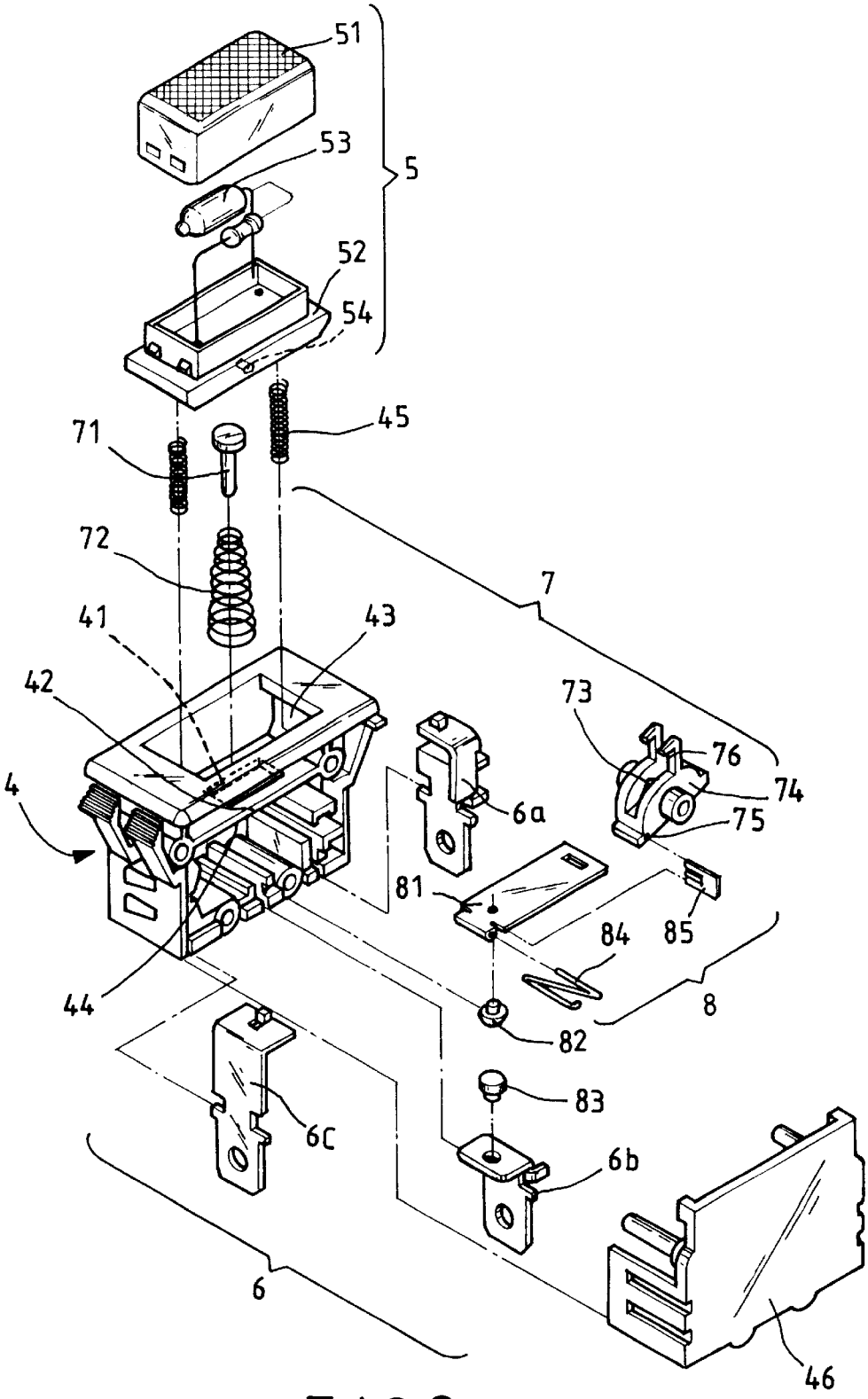
FIG. 3 is an exploded view of press button type safety switch according to Taiwan patent publication no. 458362.
Figure 4A:
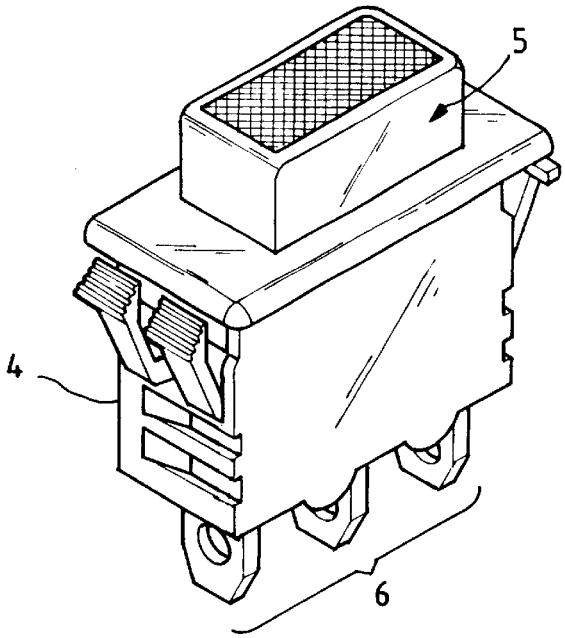
FIG. 4A is an elevational view of the present invention, showing the press button type safety switch switched off.
Figure 4B:
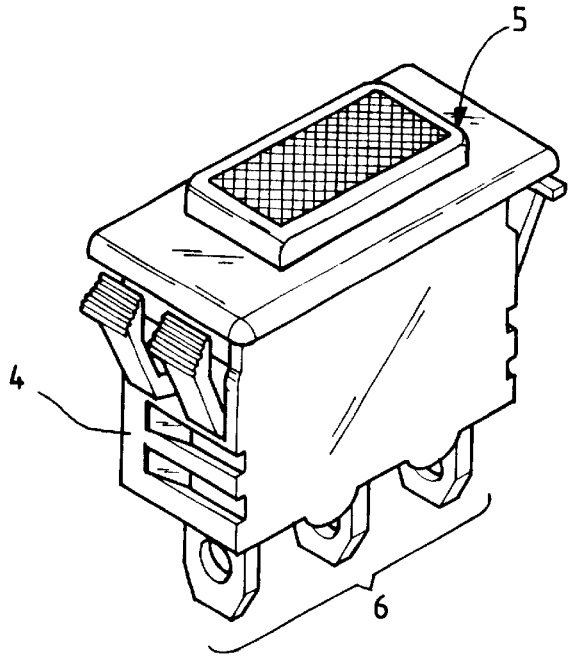

Referring to FIGS. from 3 through 9, a press button type overload protective safety switch is shown comprising a housing 4, a press button assembly 5, terminals 6 (first terminal 6*a*, second terminal 6*b*, and third terminal 6*c*), an actuating mechanism 7, and a switching mechanism 8.

The housing 4 is a hollow member having a holding chamber separated by a horizontal partition wall 42 into an upper open chamber 43 and a lower receiving chamber 44, and a through hole 41 through the horizontal partition wall 42 in communication between the upper open chamber 43 and the lower receiving chamber 44. The press button assembly 5 is supported on spring members 45 in the upper open chamber 43 of the housing 4. The terminals 6 and the switching mechanism 8 are installed in the lower receiving chamber 44 of the housing 4. The actuating mechanism 7 is mounted in the through hole 41 within the housing 4 and connected between the press button assembly 5 and the switching mechanism 8, comprising a conical spring 72 mounted on the partition wall 42, a press member 71 supported on the conical spring 72 and partially inserted into the through hole 41, and a seesaw plank 74 pivoted to the housing 4. The seesaw plank 74 has a guide groove 73, which receives the press member 71, and a positioning portion 75 connected to the switching mechanism 8.

When pressed the press button assembly 5 to lower the press member 71 into the guide groove 73 of the seesaw plank 74 and to compress the conical spring 72, thereby A, causing the seesaw plank 74 to be biased to move the switching mechanism 8 from "off" position to on" position, and therefore the circuit of the terminals 6*a*~6*c* is closed. When the user released the hand from the press bottom assembly 5 after the switching mechanism 8 has been switched on, the springs 45 and 72 push the press member 71 and the press button assembly 5 back to their former positions.

Figure 5:
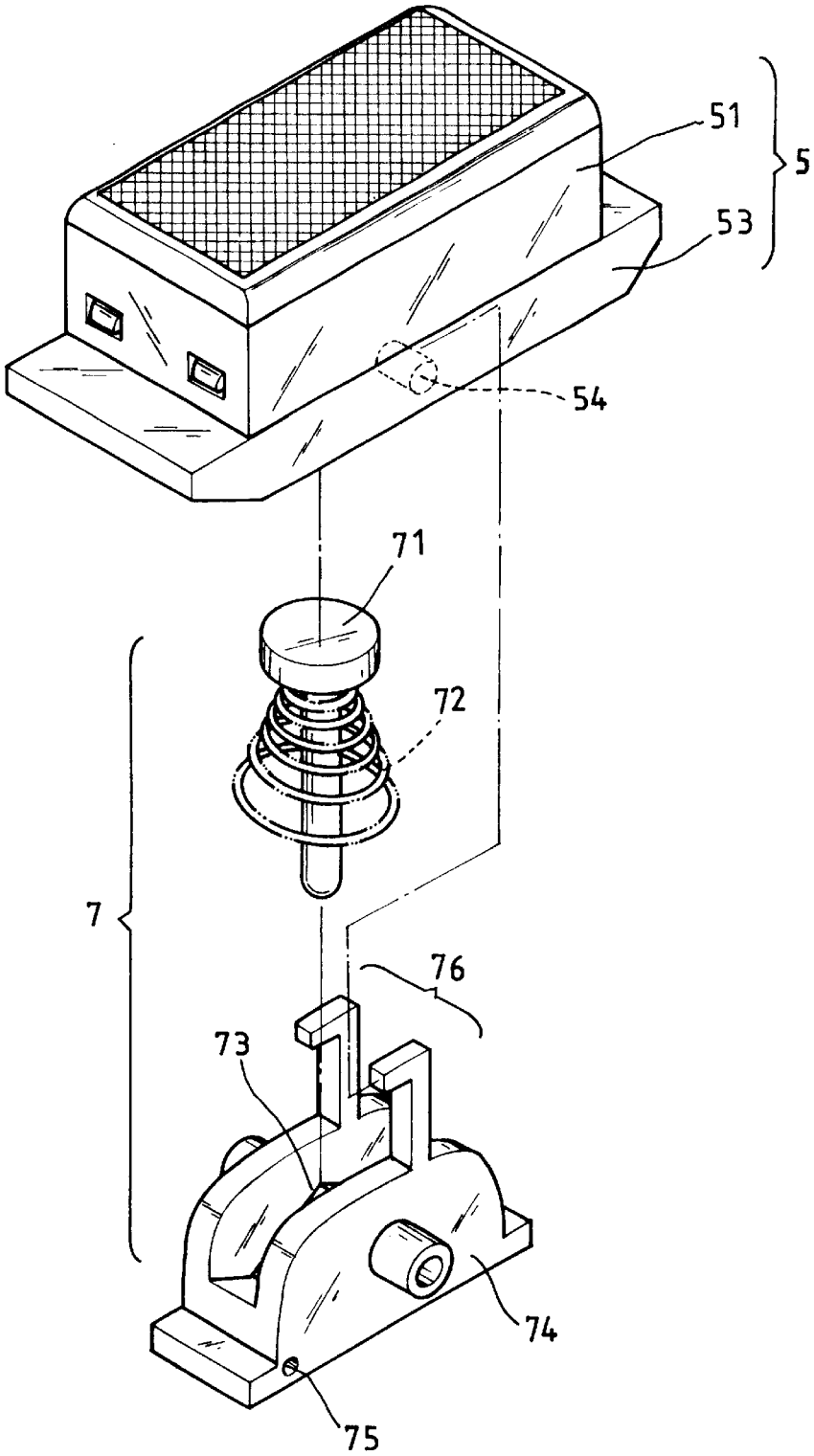
FIG. 5 is an exploded view in an enlarged scale of a part of the press button type safety switch according to the present invention.

The main feature of the present invention is outlined hereinafter. The seesaw plank 74 has at least one top hook 76 provided at the top side. According to this embodiment, the seesaw plank 74 has two top hooks 76 arranged in parallel at the top (see FIG. 5). The press button assembly 5 comprises a case-like base 52 and cap 51 covered on the base 52. The case-like base 52 has two locating rods 54 symmetrically disposed at two sides. When pressed the press button assembly 5 to lower the press member 71 and to further drive the actuating mechanism 7 to switch on the switching mechanism 8, the top hooks 76 are respectively hooked on the locating rods 54 of the case-like base 52 of the press button assembly 5, holding the press button assembly 5 at elevation h2, which is slightly above the topmost edge of the cap 51 (see FIGS. 8 and 8A). At this time, the press member 71 is pushed back to its former upper limit position by the conical spring 72. When pressed the press button assembly 5 again to switch off the switching mechanism 8 or when the switching mechanism 8 tripped off upon an overload, the top hooks 76 are disengaged from the locating rods 54, for enabling the press button assembly 5 to be pushed upwards to its former upper limit (OFF) position (see FIGS. 9 and 10).

The housing 4 has one lateral open side covered with a side cover 46. The press button assembly 5 further comprises a neon lamp 53 mounted in the case-like base 52. Alternatively, the neon lamp 53 can be eliminated and, the case-like base 52 and the cap 51 can be formed integral with each other. The switching mechanism 8 is comprised of a metal contact plate 81, a spring member 84, and a movable metal conducting plate 85. The first terminal 6*a* is fixedly connected to one end, namely, the fixed end of the metal contact plate 81 of the switching mechanism 8. The metal contact plate 81 is a bimetal plate. When an overcurrent occurred to increase the temperature of the metal contact plate 81 over a predetermined critical level, the metal contact plate 81 is caused to deform and to trip off. The other end, namely, the free end of the bimetal plate 81 has a contact 82 facing the contact 83 at the second terminal 6*b*. When the contract 82 of the bimetal plate 81 forced into contact with the contact 83 at the second terminal 6*b*, the circuit of the terminals 6 is closed, i.e., the safety switch is switched on. The spring member 84 has one end fixedly fastened to the housing 4 and the other end connected to the free end of the bimetal plate 81. The movable metal conducting plate 85 is connected between the bimetal plate 81 and the seesaw plank 74. Further, the guide groove 73 of the seesaw plank 74 slopes symmetrically downwardly from the center toward two distal ends.

Because the aforesaid press button assembly 5, the terminals 6, and the switching mechanism 8 are similar to the equivalent parts of the prior art design and not within the scope of the claims of the present invention, no further detailed description in this regards is necessary.

Figure 6:
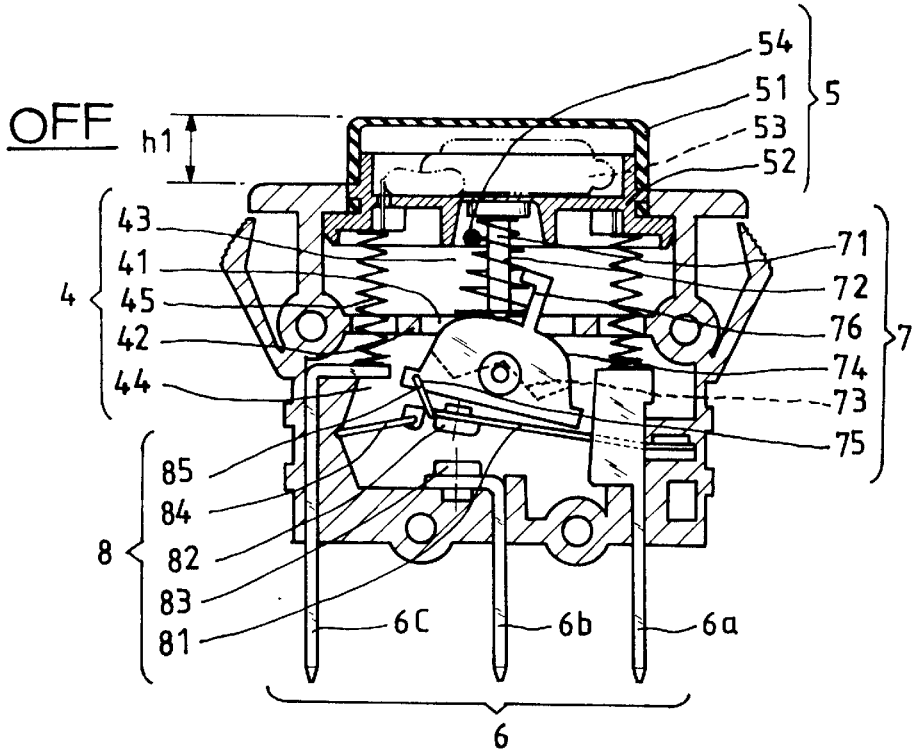
FIG. 6 is a sectional view of the present invention, showing the press button type safety switch switched off.
Figure 7:
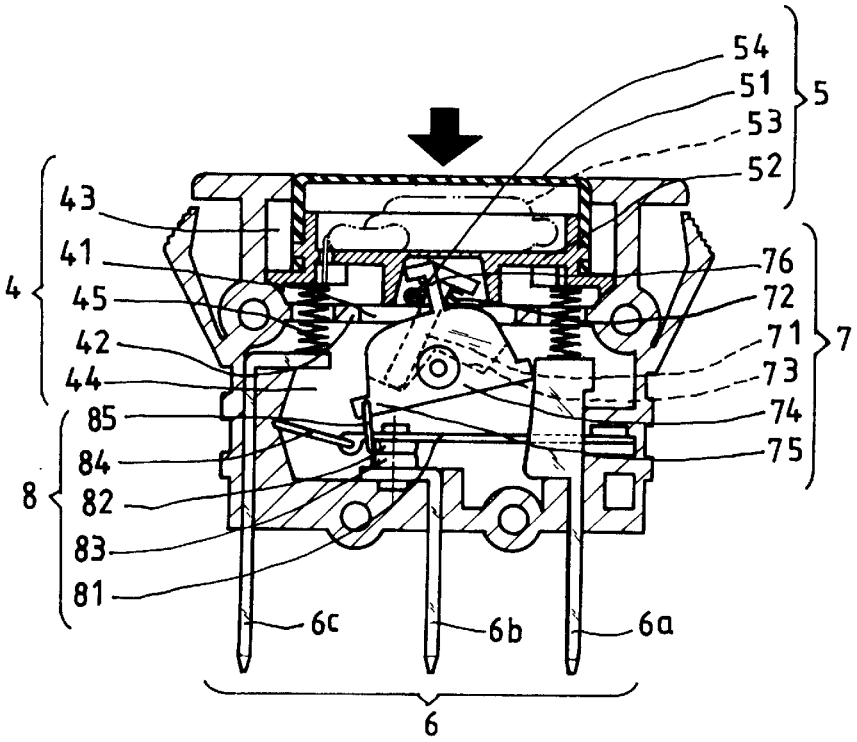
FIG. 7 is similar to FIG. 6 but showing the press button pressed.
Figure 8:
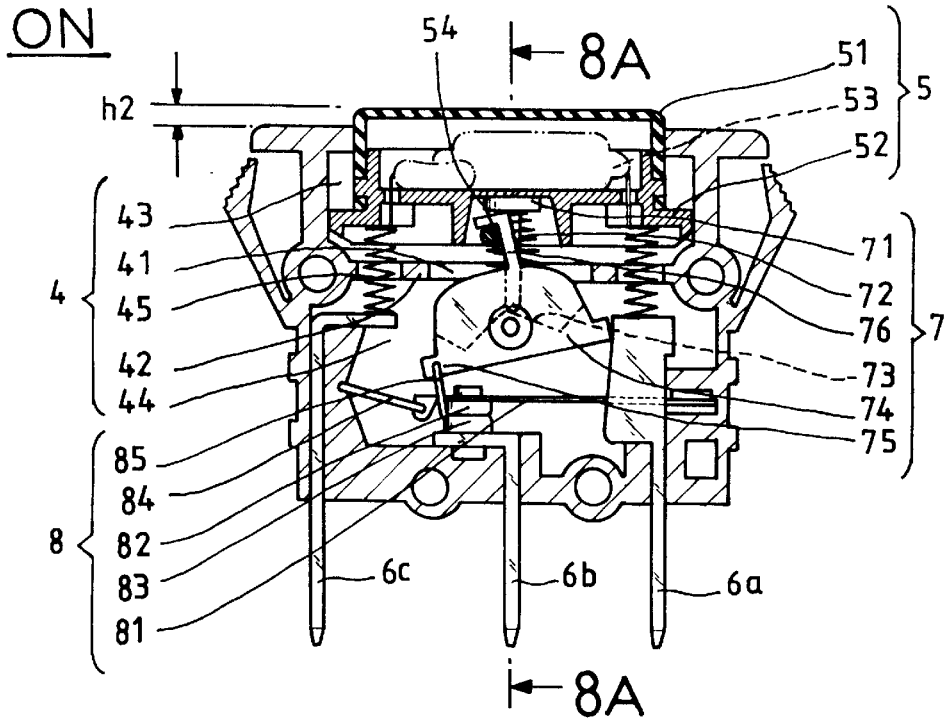
FIG. 8 is a sectional view of the present invention, showing the press button switch maintained in "on" position after the action of FIG. 7.
Figure 8:
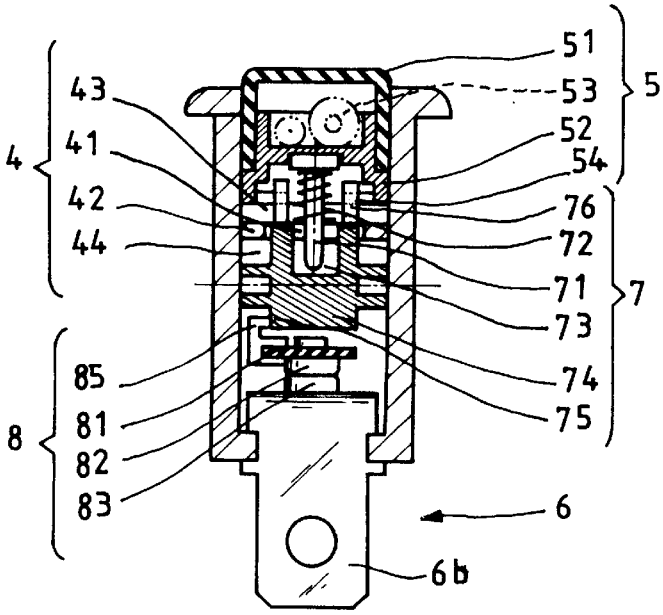

Referring to FIGS. 6 and 7, when pressed the press button assembly 5 to lower the press member 71 along the left sloping side of the guide groove 73, the seesaw plank 74 is tiled leftwards, thereby causing the contact 82 of the bimetal plate 81 to be forced into contact with the contact 83 of the second terminal 6*c*, and therefore the circuit of the terminals 6*a*~6*c* is closed. At this time, the press button assembly 5 is shifted from elevation h1 (the upper limit position) to the elevation in flush with the top side of the housing 4, and the top hooks 76 are moved with the seesaw plank 74 to a position spaced above the locating rods 54 of the case-like base 52 of the press button assembly 5. When the user released the hand from the press button assembly 5 at this time, as shown in FIG. 8, the spring members 45 push the press button assembly 5 upwards to force the locating rods 54 into engagement with the top hooks 76 of the seesaw plank 74, and therefore the top hooks 76 holds the press button assembly 5 at elevation h2. At this time, the conical spring 72 pushes the press member 71 back to its former upper limit position. Because the top hooks 76 holds the press button assembly 5 at elevation h2 when the circuit of the terminals 6*a*~6*c* maintained closed, the user knows "on" status of the safety switch from the position indication of the press button assembly 5.

Figure 9:
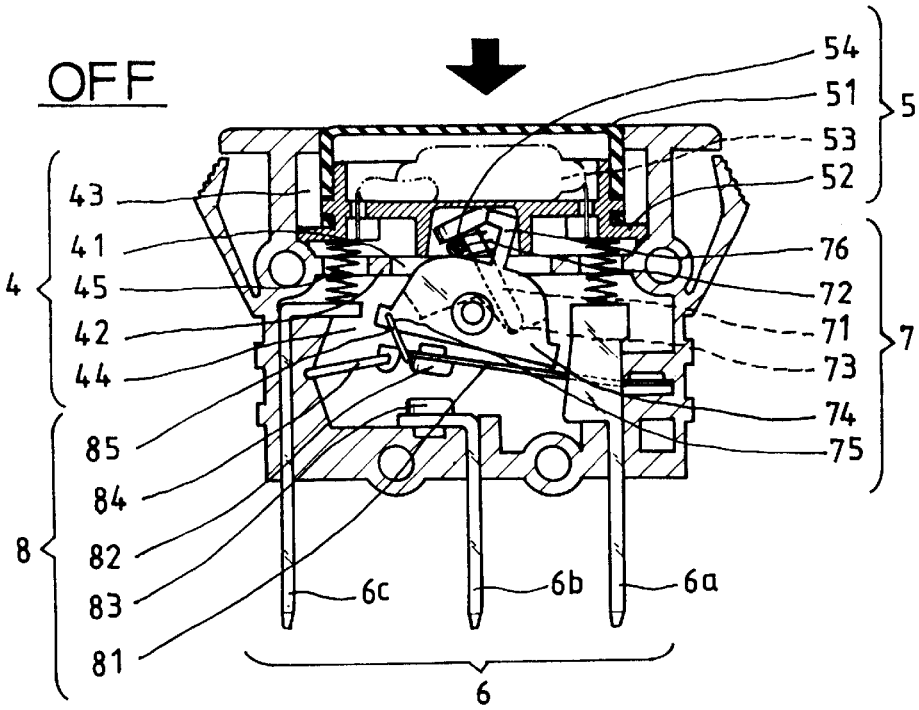
FIG. 9 is similar to FIG. 8 but showing the press button pressed.

Referring to FIG. 9, when the user pressed the press button assembly 5 again, the press member 71 is lowered from the position shown in FIG. 8 to the position shown in FIG. 9 and moved along the right sloping side of the guide groove 73 to tilt the seesaw plank 74 rightwards, thereby causing the contact 82 of the bimetal plate 81 to be moved away from the contact 83 of the second terminal 6*c*, and therefore the circuit of the terminals 6*a*~6*c* is opened. At this time, the top hooks 76 are moved away from the locating rods 54. Therefore, when the user released the hand from the press button assembly 5, the spring members 45 immediately push the press button assembly 5 back to its former upper limit position, namely, elevation h1 as shown in FIG. 6. Therefore, from the position indication of the press button assembly 5, the user knows the current off status of the safety switch.

Figure 10:
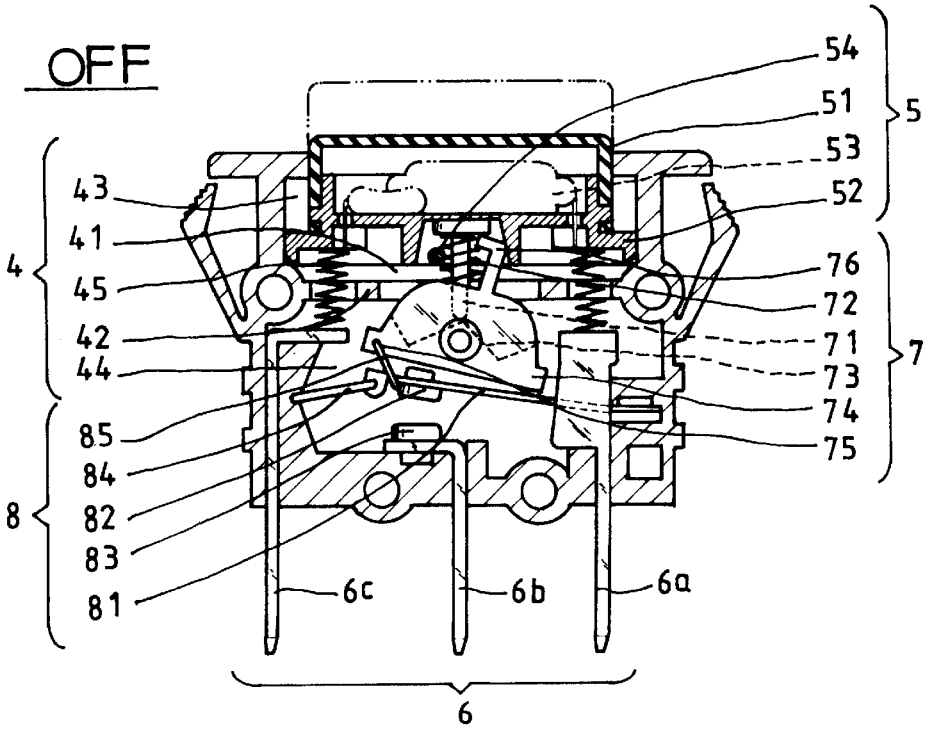
FIG. 10 is a schematic drawing showing the switching mechanism tripped off upon an overcurrent.

When an overcurrent occurred during "on" status of the safety switch shown in FIG. 8, the bimetal plate 81 is heated to deform and to curve upwards (see FIG. 10). At this time, the movable metal plate 85 moves the seesaw plank 74 to the position shown in FIG. 9 to disengage the top hooks 76 from the locating rods 54. Therefore, the safety switch is switched off and, the press button assembly 5 is returned to the position shown in FIG. 6.

Figure 13:
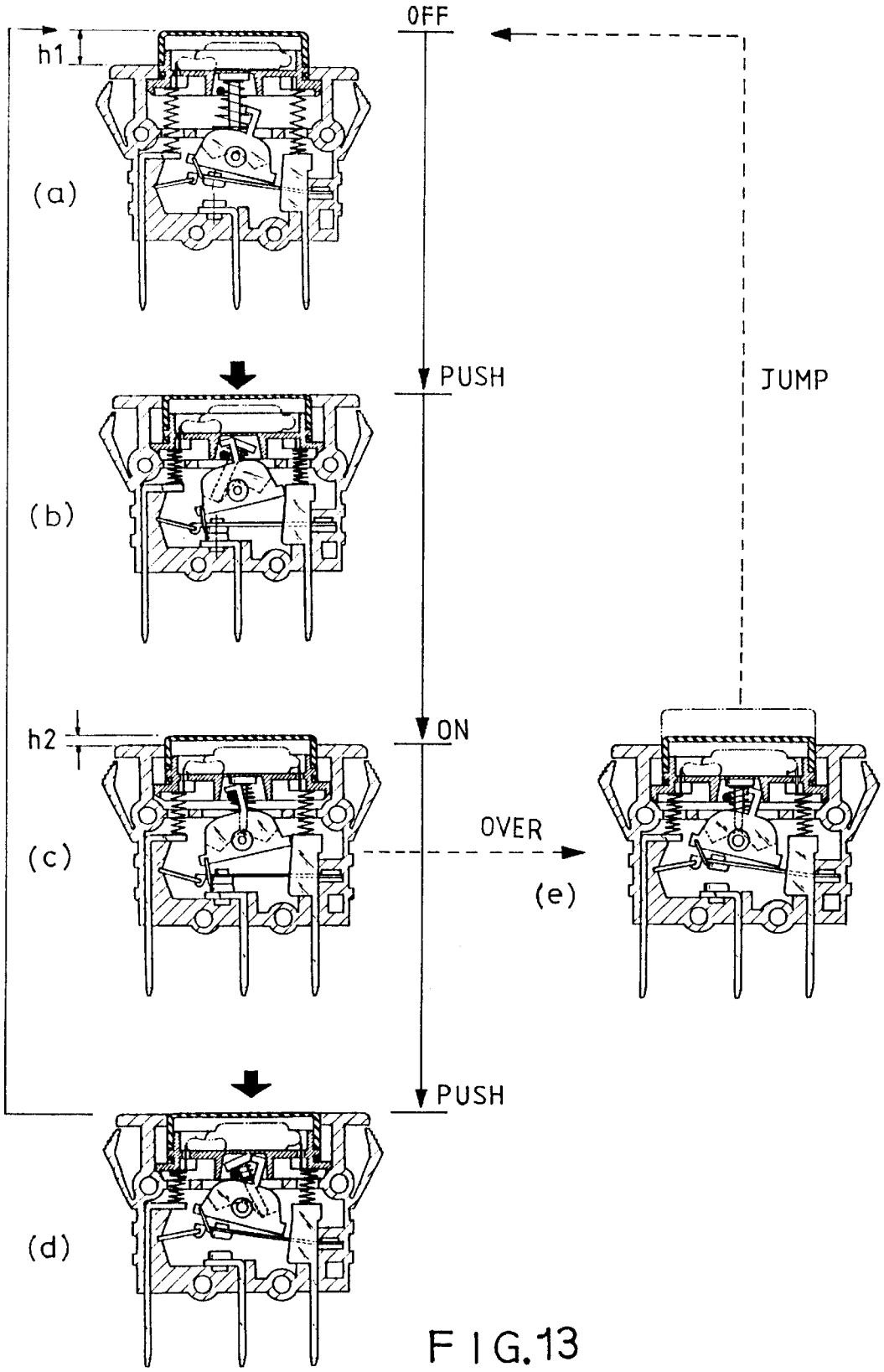
FIG. 13 is a schematic drawing showing the continuous switching actions of the present invention.

The relative action between the top hooks 76 and the locating rods 54 enables the user to view on/off status of the safety switch directly from the outer appearance of the safety switch. The operation flow of the safety switch is shown in FIG. 13. The positions (a), (b), (c), (D), (e) shown in FIG. 13 correspond to FIGS. 6~10. The step of (a)□(b)□(c) is to shift the safety switch from OFF position to ON position. The step of (c)□(d)□(e) shows the safety switch automatically trips off upon an overcurrent.

Figure 11:
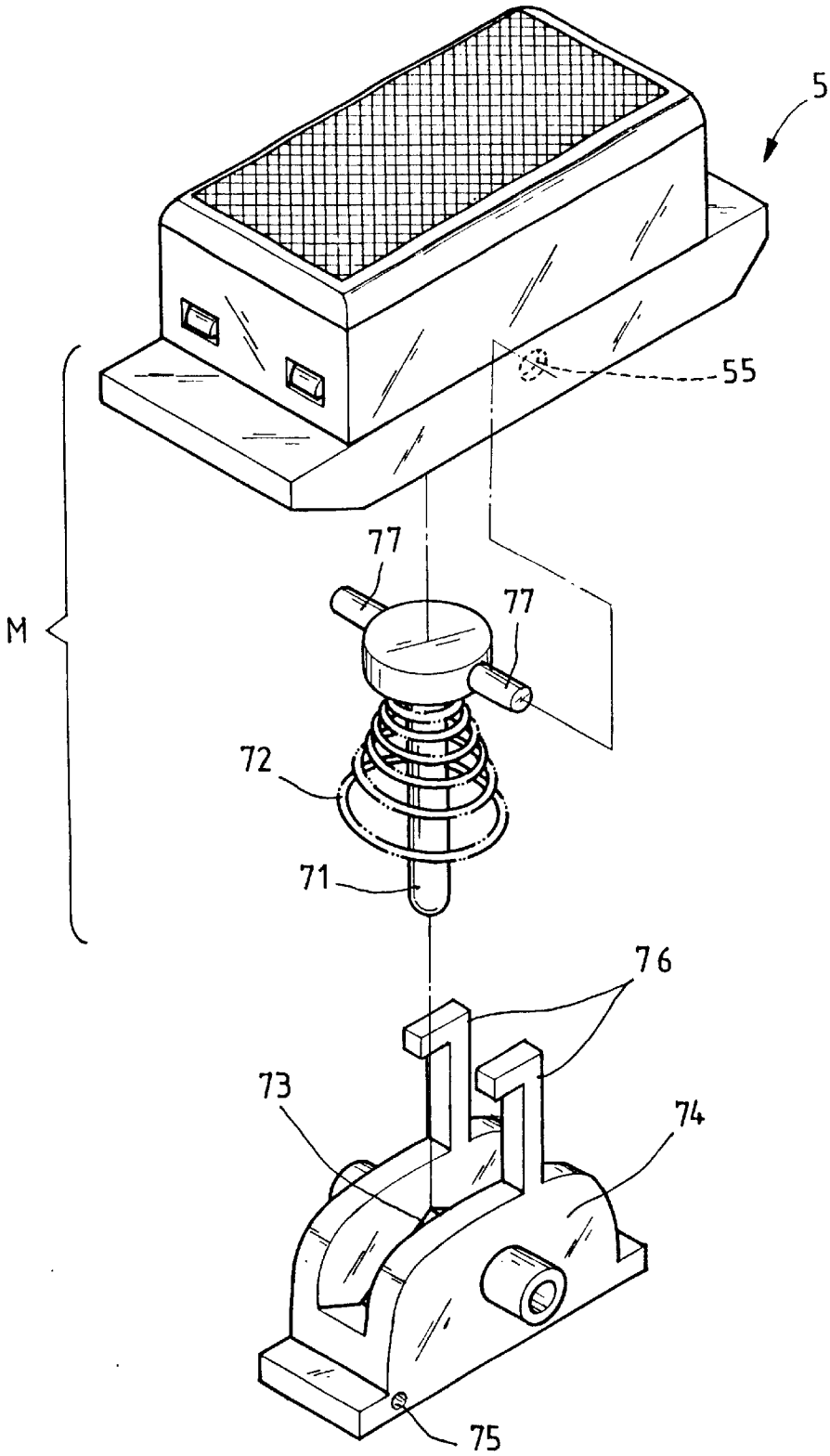
FIG. 11 is an exploded view of a part of an alternate form of the present invention.
Figure 12:
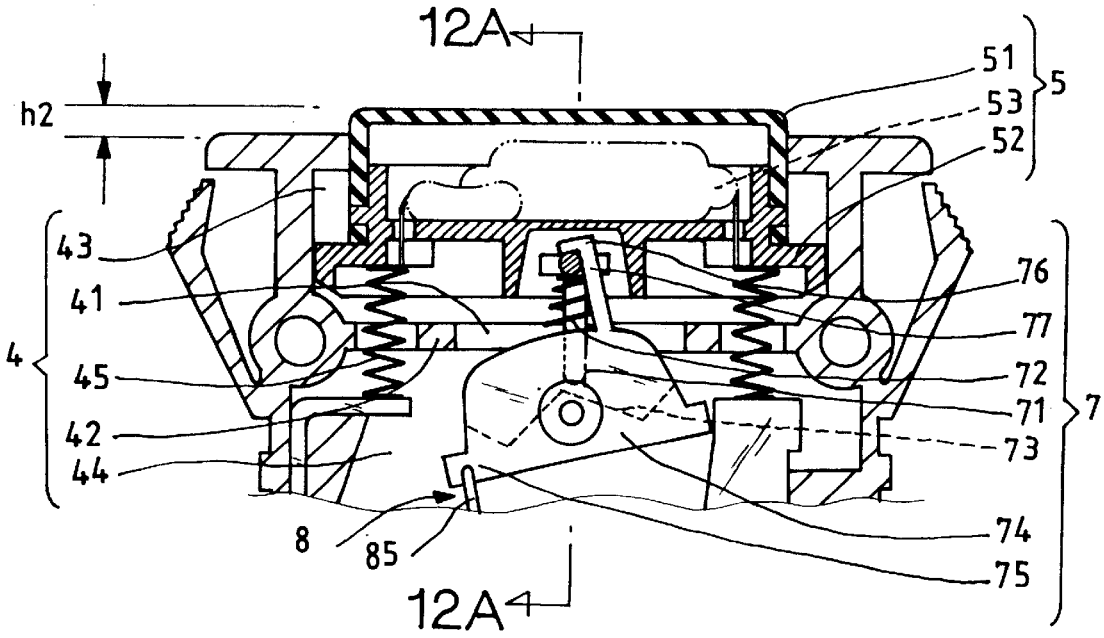
FIG. 12 is a sectional view of the alternate form of the present invention.
Figure 12A:
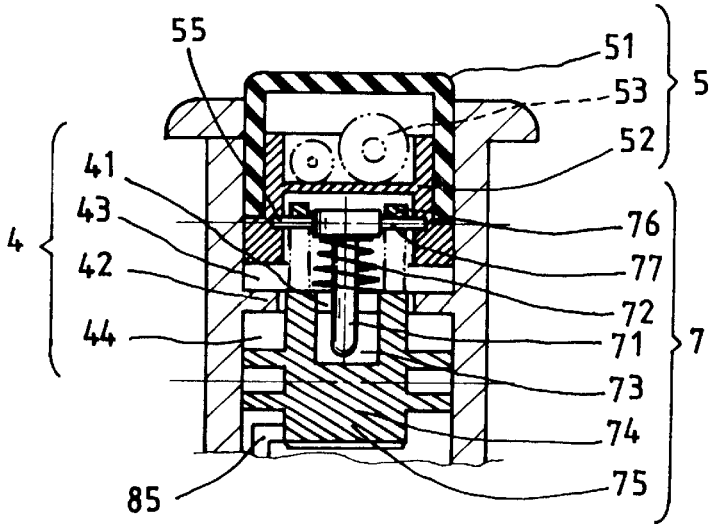
FIG. 12A is a sectional view taken along line 12A—12A of FIG. 12.

FIGS. 11, 12, and 12A show an alternate form of the safety switch. According to this alternate form, the press button assembly 5 has two locating holes 55 aligned at two sides. The press member 71 has two locating rods 77 horizontally aligned at two sides of the top of the press member 71. The press member 71 and the press button assembly 5 form a linkage M. When the safety switch switched on, the top hooks 76 are hooked on the locating rods 77 to hold the press button assembly 5 in elevation h2. On the contrary, when the safety switch switched off or tripped off, the top hooks 76 are disengaged from the locating rods 77, and the conical spring 72 pushes the press button assembly 5 back to the upper limit position (elevation h1).

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A press button type safety switch comprising:

a housing, said housing having a holding chamber separated by a horizontal partition wall thereof into an upper open chamber and a lower receiving chamber, and a through hole through said horizontal partition wall in communication between said upper open chamber and said lower receiving chamber;

a plurality of terminals installed in said lower receiving chamber of said housing and electrically connected to external power supply;

a switching mechanism installed in the lower receiving chamber of said housing and controlled to switch on/off the circuit of said terminals;

a linkage for switching on/off said switching mechanism, said linkage comprising spring members supported in the upper open chamber of said housing, a press button assembly supported on the spring members in the upper open chamber of said housing, and an actuating mechanism mounted in the through hole of said housing and connected between said press button assembly and said switching mechanism and controlled by said press button assembly to switch on/off said switching mechanism, said actuating mechanism comprising a conical spring mounted on said partition wall, a press member supported on said conical spring and partially inserted into the through hole of said housing, and a seesaw plank pivoted to said housing, said seesaw plank having a guide groove, which receives said press member for enabling said seesaw plank to be biased by said press member to switch on/off said switching mechanism, and a positioning portion disposed at one end thereof and connected to said switching mechanism;

wherein:

said linkage comprises at least one locating rod;

said seesaw plank comprises at least one top hook for hooking on said at least one locating rod of said press button assembly to hold said press button assembly in a position where the spring members in the upper open chamber of said housing maintained compressed by said press button assembly when said press button assembly pressed by the user to switch on said switching mechanism.

2. The press button type safety switch as claimed in claim 1, wherein the at least one locating rod of said linkage includes two locating rods horizontally aligned at two sides of said press button assembly; the at least one top hook of said seesaw plank includes two top hooks upwardly extended from said seesaw plank at two sides and arranged in parallel.

3. The press button type safety switch as claimed in claim 1, wherein said at least one locating rod of said linkage includes two locating rods horizontally aligned at two sides of a top end of said press member; the at least one top hook of said seesaw plank includes two top hooks upwardly extended from said seesaw plank at two sides and arranged in parallel.

* * * * *